United States Patent [19]

Kondratenko et al.

[11] Patent Number: 4,756,494

[45] Date of Patent: Jul. 12, 1988

[54] VITAL SWITCH CONTROL CIRCUIT

[75] Inventors: Robert A. Kondratenko, Elizabeth Twp., Allegheny Co.; Jack Cunningham, Forest Hills, both of Pa.

[73] Assignee: American Standard Inc., North Hills, Pa.

[21] Appl. No.: 826,719

[22] Filed: Feb. 6, 1986

[51] Int. Cl.[4] ..... B61L 19/06; B61L 5/06

[52] U.S. Cl. ..... 246/242 R; 318/293

[58] Field of Search ..... 246/240, 242 R, 221, 246/253, 263; 318/293

[56] References Cited

U.S. PATENT DOCUMENTS

| | | | |
|---|---|---|---|
| 1,996,198 | 4/1935 | Gilson | 246/242 R |
| 2,852,667 | 9/1958 | Haines | 246/242 R |
| 3,453,426 | 7/1969 | Prentice | 246/242 R |
| 3,601,603 | 8/1971 | Hughson | 318/293 X |
| 3,696,244 | 10/1972 | Hamley et al. | 246/242 R |
| 3,857,077 | 12/1974 | Kasmer | 318/293 X |

OTHER PUBLICATIONS

*Standard Handbook for Electrical Engineers*, McGraw-Hill Book Company, 1978, p. 28-8.

*Primary Examiner*—Robert B. Reeves
*Assistant Examiner*—Scott H. Werny
*Attorney, Agent, or Firm*—G. E. Hawranko

[57] ABSTRACT

A vital switch control circuit for a railroad switch machine includes a permanent magnet motor which is immune to stray or induced a.c. currents, and which is operable to either of two directions depending on the polarity of energy applied thereto. Switch-normal and switch-reverse contacts of a switch request relay logic circuit establish alternate positive and negative-current paths which are connected over a minimum number of line wires to a motor control contact arrangement and to a mechanically-interlocked, dual-coil, reversing contactor. The reversing contact is operable only above a specific d.c. voltage, therefore providing low-level d.c. immunity in case of grounding or cross-over conditions arising in the line wires. A reverse motor contact and a normal motor contact are used to alternately establish negative-current paths to the permanent magnet motor. Other reverse and normal motor contacts allow energization of the coils of the reversing contactor which have associated normal and reverse contacts, and over which the positive-current paths are established to the permanent magnet motor.

19 Claims, 3 Drawing Sheets

VITAL SWITCH CONTROL CIRCUIT

BACKGROUND OF THE INVENTION

This invention relates to a vital switch control circuit for use at a railroad installation where immunity to stray or induced a.c. currents and low-level d.c. signals is required. More specifically, this invention relates to a vital switch control circuit which advantageously utilizes a permanent magnet motor to provide immunity to the stray or a.c. stray or induced a.c. signals and a mechanically-interlocked, dual-coil, reversing contactor device, hereinafter referred to as a reversing contactor for providing immunity to the low-level d.c. signals.

The railroad switch machine, for which the subject vital switch control circuit is designed, operates to move the switch points between their two extreme positions. Such switch machines accomplish this operation typically either manually, electrically, or, often, a combination of both. When the switch machine can be electrically operated, such energy is predominantly a d.c. type power. Whichever type switch machine is used, however, precautions must be taken to avoid inadvertent switch operation caused by stray or induced a.c. signals which may be present at the railroad installation from a number of sources, including commercial a.c. power lines and a.c. transmission conductors used for vehicle traction power. Additionally, typical railroad practice is to run control cables from a central control location; for instance, a wayside control case, through a single buried conduit, to the various signal and switch devices to be controlled therefrom. Such practice, though economical in terms of initial installation costs, suffers the inherent disadvantage that, in the event of a grounding or short-circuit condition arising within the single conduit, low-level d.c. signals used for traffic control may cross over to the switch control lines. Additional d.c. interference may arise where the vehicle traction power is d.c. To prevent such an undesired signal cross-over from inadvertently throwing a switch machine under a moving train, for instance, elaborate check schemes between the switch control vital components and the motor which effects switch movements are required. These check schemes further complicate the installation and maintenance operations by requiring additional connecting lines between the control locations and the switch machine. Since the distance between the control location and the switch machine can, at times, be quite large, an additional cost arises for such installation and maintenance operations.

SUMMARY OF THE INVENTION

It is, therefore, an object of the invention to provide a vital switch control circuit which would operate at a railroad interlocking essentially immune to interference from stray or induced a.c. currents.

It is a further object of the invention to provide such a vital switch control circuit which is additionally immune to low-level d.c. cross-over signals.

It is yet a further object of the invention to provide such a vital switch control circuit having immunity to interference of a low-level d.c. nature, which accomplishes such immunity using a minimum number of wiring connections between a central control location and the switch machine.

Yet another object of the invention is to provide such a vital switch control circuit which utilizes a permanent magnet motor to achieve immunity from stray or induced a.c. currents.

An even further object of the invention is to provide such a vital switch control circuit which achieves this immunity to low-level d.c. interfering signals using a pair of precisely-wound, specific voltage-operating contact coils which operate only above a specific voltage level.

Still another object of the invention is to provide such a vital switch control circuit using a mechanically-interlocked, reverse-acting, dual-coil contactor device to achieve the low-level d.c. immunity, which mechanical interlocking of the contactor device is achieved through a cooperative linking of the armatures associated with the two distinct contactor coils, there being no electrical connection between said coils.

Briefly, a presently preferred embodiment consists of a permanent magnet motor, operable in either of two directions for providing the motive force for a switch machine to move between its two extreme positions, the motor operating in either direction as a function of the polarity of the energy applied thereto. Positive and negative energies can be switched with respect to the permanent magnet motor by use of a mechanically-interlocked, reverse-acting, dual-coil contactor device and a relay logic arrangement using contacts of switch-normal and switch-reverse request relays. Cam-operated switch contacts or motor control contacts are disposed in current paths to the reversing contactor device and the permanent magnet motor. These motor control contacts are closed for a period of time from one locked switch position, through movement to the opposing switch position, and are not opened until just prior to the switch points achieving this opposite position. Contacts associated with the two coils of the reversing contactor, these being reverse and normal contacts, are disposed parallel to additional cam-operated motor control contacts. In one configuration of the invention (a high-voltage, two-wire configuration), steering diodes are disposed in series with the reverse and normal coils of the reversing contactor in such a manner that the positive and negative energies can be directed thereby.

DESCRIPTION AND OPERATION

Figure 1:
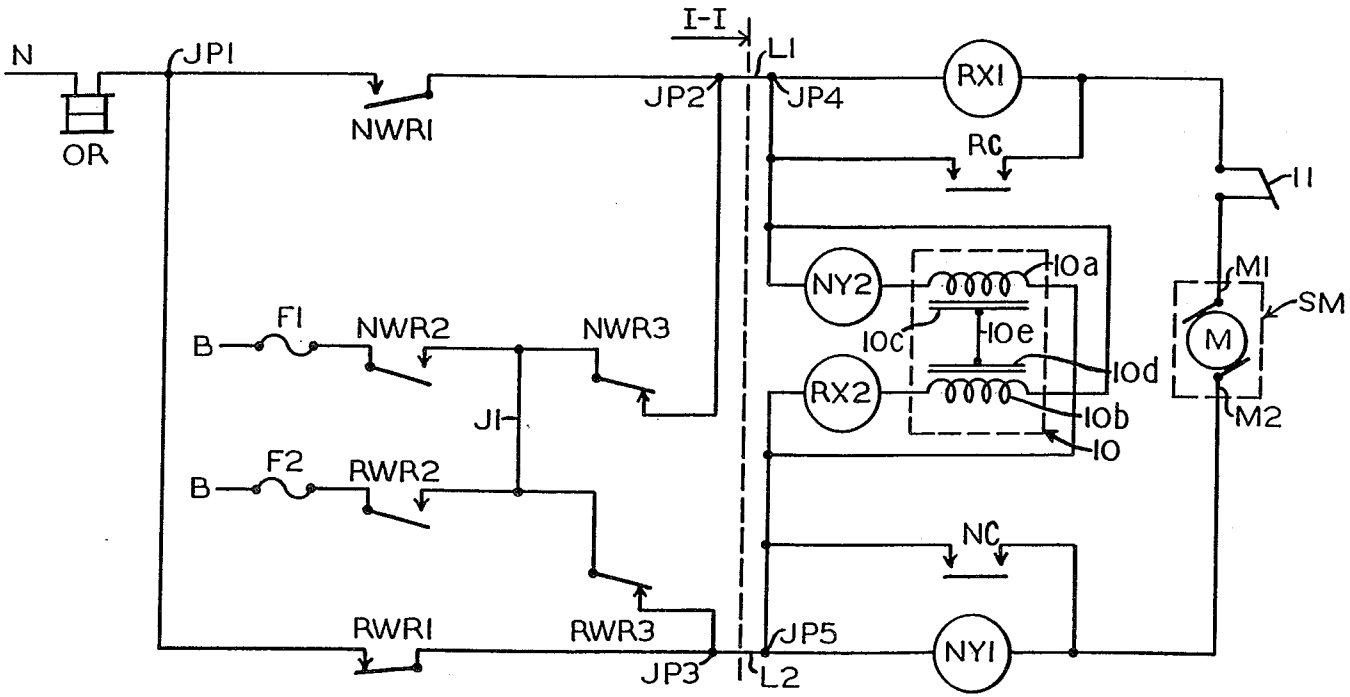
FIG. 1 is a diagrammatic view of a vital switch control circuit constructed in accordance with the invention.

As seen in FIG. 1, the vital switch control circuit for a two-wire, low-voltage arrangement includes a permanent magnet motor, designated M in the FIGURE. The permanent magnet motor M provides the motive force for operating the switch machine SM (shown in dashed block diagram form in FIG. 1) between two extreme positions; a switch-normal position and a switch-reverse position. The two-switch machine positions correspond to the positions of the railroad switch points (not shown) in accordance with railroad industry standards. The use of the permanent magnet motor M (as will presently be described) provides inherent advantages particularly beneficial to a railroad signaling installation where a.c. signals are regularly present from a commercial source or from a.c. traction power for the vehicle traveling therethrough. The primary advantage is the immunity of permanent magnet motor M exhibited with respect to stray or induced a.c. currents resulting from the above-mentioned a.c. signals. Additionally, the permanent magnet motor M provides other advantages over other types of motors, such as, the wound field motor; for instance, energy-consumption is lower sine no electric power is needed to generate the magnetic flux, and the permanent magnet motor can be sized smaller and be of a lighter weight than a wound field motor for a given output power.

As further seen in FIG. 1, there are two motor leads M1, M2 connected to the permanent magnet motor M. It can be appreciated that the permanent magnet motor M can be actuated to operate in either a clockwise or a counterclockwise direction, depending on the polarity of the energies presented to the two motor leads M1, M2. A handthrow cutout contact 11 is disposed in series to one or both of the motor leads M1, M2, and is effective for interrupting energy to the permanent magnet motor M when the switch machine SM has been selected to operate manually. In this manner, inadvertent electrical control of the permanent magnet motor M and, hence, switch machine SM, is prevented. The necessity of this feature can best be seen where, following a power-outage and selected manual throwing of the switch machine, power is returned and the circuitry wants to assume the conditions prior to the outage.

As further seen in FIG. 1, there are essentially two portions of the vital switch control circuit (shown to the left of the dashed line I—I), which is the switch-request logic typically located at a point distant from the switch machine and that shown to the right of the dashed line I—I, which includes interlocking contactor means such as the reversing contactor 10 and associated contacts NC, RC; motor control contacts NY1, NY2, RX1, RX2; and the permanent magnet motor M, all of which will be described hereinafter in further detail.

Connecting the two portions of the vital switch control circuit, are two line wires shown in the FIGURE as L1 and L2, which line wires L1, L2 can extend a distance in a magnitude of hundreds of feet. It can be appreciated that, inasmuch as the switch control line wires L1 and L2 are run together with other wires which control railroad signals and other devices (all of which are typically buried), it is advantageous, both from an original installation cost and from a later maintenance cost, to keep the number of line wires to a minimum. With regard to the switch-request logic (shown to the left side of the line I—I), it can be seen that the negative energy N, eventually connected to operate the permanent magnet motor M, is first introduced to the vital switch control circuit over an overload relay OR. The overload relay OR serves the purpose of preventing current-overload of the permanent magnet motor M in the event the switch machine SM becomes jammed during the movement to one of its two operating positions. If such an event were to occur, the switch machine SM would continue to draw current for a period of time in excess of a predetermined amount of time. The overload relay OR, under this condition, acts to energize its coil; in other words, the overload relay is a slow pickup relay and exhibits only minimal resistance to the negative energy N prior to coil pickup. A first junction point JP1 leads from one side of the overload relay OR to two separate parallel lines. One of such parallel lines, which can be termed a first branch of a negative energy path, extends from the first junction point JP1 and has disposed thereon a first switch-normal contact NWR1; while the other of such parallel lines, which can be termed a second branch of a negative energy path, has a first switch-reverse contact RWR1 disposed thereon. The first switch-normal contact NWR1 and the first switch-reverse contact RWR1 are each associated with respective switch-normal and switch-reverse request relays (not shown). These request relays are energized, thereby picking or closing the switch-normal and switch-reverse contacts, when it is desired to move the switch points (not shown) to their opposite position; of course, it is assumed that only one switch-request relay can be energized at a time, and only when all other vital circuits are in compliance. Upon closing one or the other of the first switch-normal and switch-reverse contacts NWR1 or RWR1, the portion of the circuit connecting the negative energy to the permanent magnet motor M for the portion of the vital switch control circuit (shown to the left of line I—) is established. Similarly, the positive energy B is connected through to the portion of the vital switch control circuit (shown to the right of line I—I) by use of additional contacts of the normal-switch and reverse-switch request relays (not shown). In a first branch of a positive energy path, a first fusing element F1 is disposed between the positive energy source B and a second switch-normal contact NWR2. The fusing element F1 can either be a fuse, a circuit breaker, or any other type of overload-protection device. The second switch-normal contact NWR2, similar to the first switch-normal contact NWR1, is a normally open-type contact; that is, the contact is not closed to complete the circuit until the associated coil is energized.

A second branch of the positive energy path has a second fusing element F2, disposed in series between the positive energy source B and a second switch-reverse contact RWR2. The first and second switch-reverse contacts RWR1 and RWR2 are also normally open-type contacts. A first shunt jumper J1 connects the first and second branches of the positive energy paths at a point past the respective second switch-normal and second switch-reverse contacts NWR2 and RWR2. A third switch-normal contact NWR3 is disposed in series to the second switch-normal contact NWR2 in the first branch of the positive energy path beyond the first shunt jumper J1. This third switch-normal contact NWR3 is a normally closed-type contact; that is, the circuit is made over this contact when the associated coil is not energized. The third switch-normal contact NWR3 then connects to the first branch of the negative energy at a second junction point JP2, which is a point past the first switch-normal contact NWR1.

Similarly, a third switch-reverse contact RWR3 is disposed in series to the second switch-reverse contact RWR2 in the second branch of the positive energy path beyond the first shunt jumper J1. This third switch-reverse contact RWR3 is also a normally closed-type contact and connects to the second branch of the negative energy path at a third junction point JP3, which is disposed beyond the first switch-reverse contact RWR1. It can be observed that this apparent energy cross-over will not result in a short-circuit condition, since the positive energy path can only be connected to the negative energy path when one of the first switch-normal or first switch-reverse contacts NWR1 or NWR2 is opened, corresponding to a deenergization of that associated relay and establishing a break in the negative energy path at that point.

From the second and third junction points JP2 and JP3, the first and second line wires L1 and L2 connect the positive and negative energy paths to the portion of the vital switch control circuit (shown on the right-hand side of dashed line I—I). Branching off from the first line wire L1, at a fourth junction point JP4, is a connection to a first reverse motor contact RX1. The first reverse motor contact RX1 is an electrical connection on the order of a contact closure, which connection is completed from the time the switch points are locked in the reverse position, through unlocking and movement of the switch points to the normal position; and are not, in fact, opened until just prior to the switch points reaching the normal position. Typically, switch motor contacts are provided from a cam-operated motor control arrangement, associated with a switch machine SM in conjunction with a series of cam-operated point-indication contacts which are tied to the switch points (not shown) over an arrangement of detection and locking rods. Connected to the other side of the first reverse motor contact RX1 is the handthrow cutout contact 11. Branching off from the second line wire L2 and a fifth junction point JP5 is a first normal motor contact NY1. This first normal motor contact NY1 is completed, thereby making a through connection, from the time the switch points are locked in the normal position, and are not opened until just prior to the switch points reaching the reverse position. This through connection, over the first normal motor control NY1, then connects into the second motor lead M2 to the permanent magnet motor M.

Also branching off from the first line wire L1, at the fourth junction point JP4, is a second normal motor contact NY2; which, when closed simultaneously to the first normal motor contacts NY1, couples the first line wire L1 to the reversing coil 10*a* of the reversing contactor 10.

Associated with the reversing coil 10*a* is a reversing armature 10*c* and a reverse contact RC. The reverse contact RC, associated with the reversing coil 10*a*, is a normally opened contact, and is connected in parallel across the first reverse motor contact RX1; the purpose of which will be described hereinafter in further detail. The reversing coil 10*a* is also connected, on the end opposite the connection to the second normal motor contact NY2, to the second line wire L2 at the fifth junction point JP5.

As further seen in FIG. 1, branching off from the second line wire L2, at the fifth junction point JP5, is a second reverse motor contact RX2; which, when closed simultaneously to closure of the first reverse motor contact RX1, makes a through connection to one side of a normal coil 10*b* portion of the reversing contactor 10. The connection of the normal coil 10*b*, opposite this one side, is connected to the first line wire L1 at the fourth junction JP4. Associated with the normal coil 10*b* of the reversing contact 10 is a normal armature 10*d* and a normally open normal contact NC. The normal contact NC is connected in parallel across the first normal motor contact NY1 for vitality purposes, as will be described hereinafter in further detail. Disposed between the normal armature 10*d* and the reverse armature 10*b* of the reversing contact 10 is a mechanical interlock element 10*e*, which serves to mechanically-interlock the normal and reverse armatures 10d and 10*b* for opposing coincident movement. One way of achieving such mechanical interlocking arrangement is to provide a pivotable rocking arm, connected to each of the armatures, which translates movement of one armature to an opposing condition of the other armature; that is, if the reverse armature 10*b* would pick up as a result of the reverse coil 10*a* being energized, the normal armature 10*d* would be prevented from assuming an actuation position.

In operation, the vital switch control circuit for a low-voltage, two-wire configuration (as shown in FIG. 1) will first be described for the situation where the switch points are locked in the normal position, and it is desired to throw the switch to the reverse position.

Prior to picking the switch-reverse request relay (not shown), it will be observed that the first and second normal motor contacts NY1 and NY2 are closed, thereby forming an electrical connection therethrough. Simultaneously, the first and second switch-reverse point indications RX1 and RX2 must be in an opened condition, thereby preventing an electrical connection therethrough.

Upon energization of the coil associated with the switch-reverse request relay (not shown), the normally opened first and second switch-reverse contacts RWR1 and RWR2 will close, while the normally closed third switch-reverse contact RWR3 will open. At this time, negative current energy will flow through the overload relay OR since the predetermined pickup time has not been exceeded, through the first junction point JP1, through the second branch of the negative current energy path, over the closed first switch-reverse contact RWR1, and to the third junction point JP3 where it will travel over the second line wire L2. The first branch of the negative current energy path will be open at this time, as a result of the first switch-normal contact NWR1 being opened. Similarly, the first branch of the positive current energy path is opened by the second switch-normal contact NWR2 being opened. Therefore, the second branch of the positive energy circuit must provide the positive current energy over the closed second switch-reverse contact RWR2, the first shunt jumper J1, the normally closed third switch-normal contact NWR3, and the second junction point JP2 to the first line wire L1. It will be observed that the positive current energy B cannot travel over the third reverse-switch contact RWR3 when the switch-reverse request relay (not shown) is energized, thereby preventing a short-circuit condition. However, in the event the third switch-reverse contact RWR3 would fail and cause a short-circuit condition, the second fusing element F2 is sized to prevent damage to the circuit elements. The system vitality is therefore insured, since the failure would be to a condition where the permanent magnet motor is isolated from any positive energy source, including the first branch of the positive energy path, which is opened by way of the second normal-switch contact NWR2.

With the positive energy B present at the fourth junction point JP4 and the second normal motor contact NY2 being closed (as previously described), positive Furthermore, with the opposite side of the reversing coil 10*a* being coupled to the negative energy at the fifth junction point JP5, the reversing coil 10*a* is energized and tion point JP5, the reversing coil 10*a* is energized and the reverse armature 10*c* is actuated, closing the reverse contact RC. Prior to this reversing coil energization, no positive energy was available to the permanent magnet motor M since the first reverse motor contact RX1 and the reverse contact RC were previously in an opened condition. In this manner, it can be appreciated that the reversing contactor 10 must first utilize the energy tranmitted over the line wires L1 and L2 to operate the permanent magnet motor M. Therefore, by providing that the coils of the reversing contactor 10 be operable only above a certain voltage level, inadvertent energization of the permanent magnet motor M (as may occur without first utilization by the reversing contactor 10) is effectively prevented.

With the reverse contact RC (associated with the reversing contactor 10) picked up, thereby coupling positive energy over the closed handthrow cutout contact 11 to the first motor lead M1, and the negative energy being provided over the first normal motor contact NY1 to the second motor lead M2, the permanent magnet motor M can move the switch points (not shown) to the requested reverse position. Therefore, other known relay logic techniques thereafter react by dropping the switch-reverse request relay (not shown), thereby freeing up the vital switch control circuit for the next request.

The vitality of the vital switch control circuit and the operation thereof will be preserved, regardless of any component failure. For instance, if, following movement of the switch machine SM to the reverse position, the reverse armature **10*c* became welded in the energized position, subsequent energization of the permanent magnet motor M is prevented, since the opening of the first normal motor contact NY1 will break the current path to the permanent magnet motor M. Should a request for a switch-normal position be entered, vitality is further protected since the mechanical interlocking, by way of the mechanical interlock element 10*e*, prevents the normal armature 10*d*** from assuming the actuated position; positive energy, therefore, cannot be applied since the normal contact NC and the first normal motor contact NY1 are opened.

If the switch machine SM is manually thrown to the normal position, and power then restored, the permanent magnet motor M will continue to drive since the negative energy will be coupled over the welded reverse contact RC and the positive energy will be coupled over the now-closed first normal motor contact NY1. Eventually, the coil of the overload relay OR will pick up, thereby effecting removal of energy to the vital switch control circuit.

Figure 2:
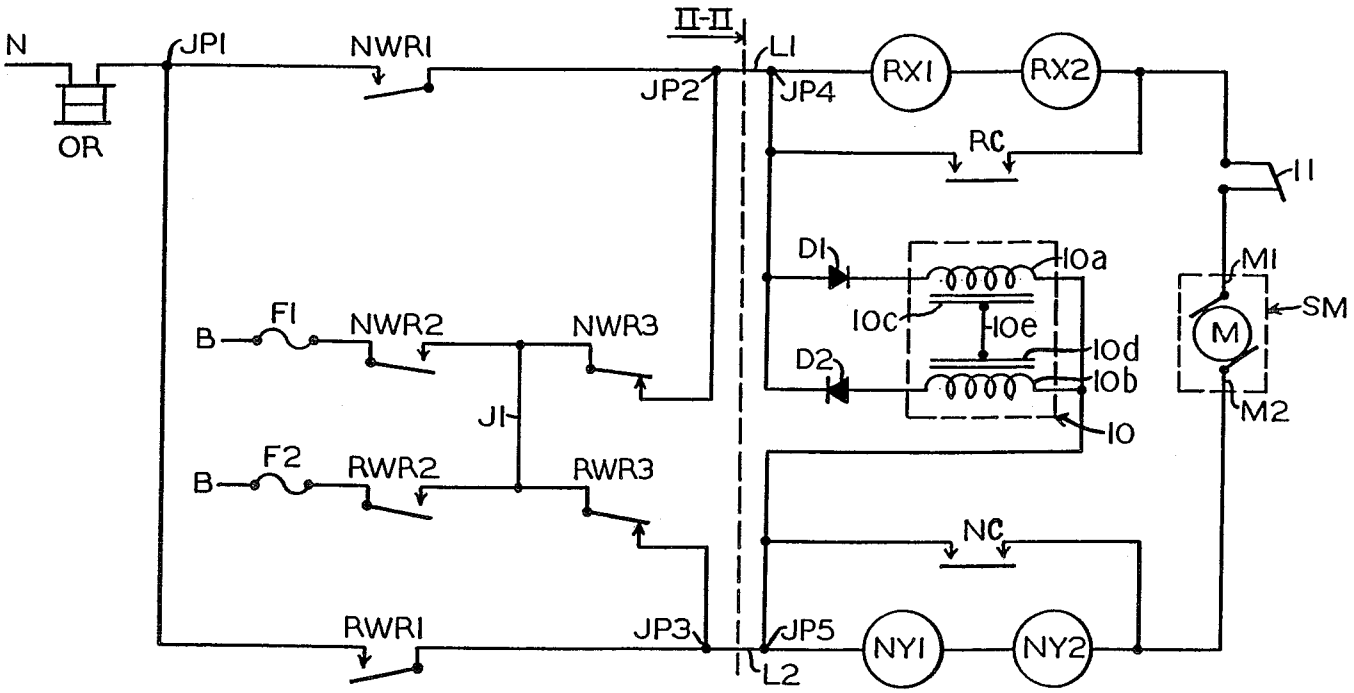
FIG. 2 is a diagrammatic view of a vital switch control circuit constructed in accordance with an alternate embodiment of the invention.

The vital control circuit (shown in FIG. 2) is for a high-voltage, two-wire arrangement, but is substantially similar to that of the low-voltage arrangement shown in FIG. 1 and, as such, will utilize essentially the same elements and reference designations. In fact, the portion of the vital switch control circuit shown to the left of dashed-line II—II in FIG. 2 is the same as that shown in FIG. 1. Accordingly, only the portion of the vital switch control circuit to the right of dashed-line II—II will be presented here.

Branching off from the first line wire L1, at the fourth junction point JP4, is a series-connection to the first and second reverse motor contacts RX1, RX2, which are disposed in series and which connect, through the handthrow cutout contact 11, to the first motor lead M1 of the permanent magnet motor M. Similarly, branching off from the second line wire L2, at the fifth junction point JP5, is a series-connection of the first and second normal motor contacts NY1, NY2 which then, in turn, connect in series to the second motor lead M2.

The use of the two consecutive motor contacts serves the purpose of extinguishing an electrical arc that may arise across the points due to the slow contact opening, as can occur at low temperatures. By so arranging the motor contacts, the opening velocity of the contact portions is effectively doubled.

FIG. 2 further illustrates an alternate arrangement for energizing the reverse and normal coils **10*a*, 10*b* of the reversing contactor 10. A first steering diode D1 is arranged to allow positive energy to flow from the fourth junction point JP4 to one side of the reverse coil 10*a*, while a second steering diode D2 is arranged opposite the first steering diode D1 and prevents positive energy from flowing from the fourth junction point JP4 to the normal coil 10*b*. Conversely, when there is a negative energy present at the fourth junction point JP4 (as can occur when the switch-normal contacts NWR1, NWR2, NWR3 are actuated), the first steering diode D1 prevents negative energy from being coupled to the reverse coil 10*a*, while the second steering diode D2 allows current to flow to the one side of the normal coil 10*b***. In this manner, the checking of the polarity of the energy, and hence the integrity of the switch-request circuitry shown to the left of line II—II, can be accomplished more economically than by the use of the point-indication elements. This is especially beneficial also where the number of available motor contacts are limited because of alternate uses of such motor contact as, for instance, their use for arc suppression.

Typical railroad circuit design techniques to date have prohibited the use of rectifying devices, such as diodes, for vital circuit applications exposed to foreign a.c. current. However, by using a permanent magnet motor M, which is immune to stray or induced a.c. current, it is now feasible to safely use such rectifying devices for a vital switch control circuit.

In operation, the vital switch control circuit for a high-voltage, two-wire arrangement will be discussed, based on the assumption that the switch machine SM and the switch points (not shown) are in and locked in the reverse position, and it is desired to move to the normal position. The existing conditions find the first and second reverse motor contacts RX1 and RX2 closed, and the first and second normal motor contacts NY1 and NY2 opened.

When the switch-normal request relay (not shown) is first energized, all three switch normal contacts NWR1, NWR2 and NWR3 will be picked up. Positive energy B will be presented to the second line wire L2 over the second switch-normal contact NWR2, the shunt jumper J1, the third switch-reverse contact RWR3, and the third junction point JP3. The negative energy N will be presented to the first line wire L1 over the overload relay OR which is not picked up, over the first switch-normal contact NWR1, and over the second junction point JP2.

With the first and second reverse motor contacts closed and the manual release contact 11 closed, negative energy N will be presented to the first motor lead M1 of the permanent magnet motor M. Negative energy will also be applied to one side of the normal coil **10*b* of the reversing contactor 10 over the second steering diode D2, while the positive energy for the normal coil 10*b* will be coupled directly from the fifth junction point JP5. The normal armature 10*d* of the reversing contactor will then be actuated, thus picking up or closing normal contact NC of the reversing contactor 10**. Positive energy can then flow over the closed normal contact NC to the second motor lead M2, thereby energizing the permanent magnet motor M to effect operation of the switch machine SM to the switch-normal position. Following final movement to the switch-normal position, the first and second reverse motor contacts RX1 and RX2 will be opened and the first and second normal motor contacts NY1 and NY2 will be closed.

The vitality of the vital switch control circuit for high-voltage, two-wire arrangement is preserved, even in the event of a failure of either of the steering diodes D1, D2. To illustrate, it will first be assumed that the switch machine SM is requested reverse from a full normal condition and the second steering diode D2 exhibits a short-circuit condition, thus allowing the normal coil 10b to be energized. In this situation, positive energy B cannot flow to the first motor lead M1 since the first and second reverse motor contacts RX1 and RX2 are opened, as is the reverse contact RC of the reversing contactor 10.

If the first steering diode D1 were to exhibit a short-circuit condition during a request to a normal position, while in a full normal position, the reverse contact RC would be closed, allowing negative energy to flow thereover, thus bypassing the open condition of the first and second reverse motor contacts RX1 and RX2. In this situation, the permanent magnet motor M will continue to drive in a normal direction, but will have current interrupted when the overload relay OR is energized following expiration of the predetermined time period.

All other failures, such as open diodes and broken leads, will result in the switch machine remaining in position, fully locked and so indicating. The integrity of the shunt jumper J1 is also verified by circuit operation merely by the presence of positive and negative energies over the first and second line wires L1 and L2; if the shunt jumper J1 were to fail, such energies could not be applied thereover.

Figure 3:
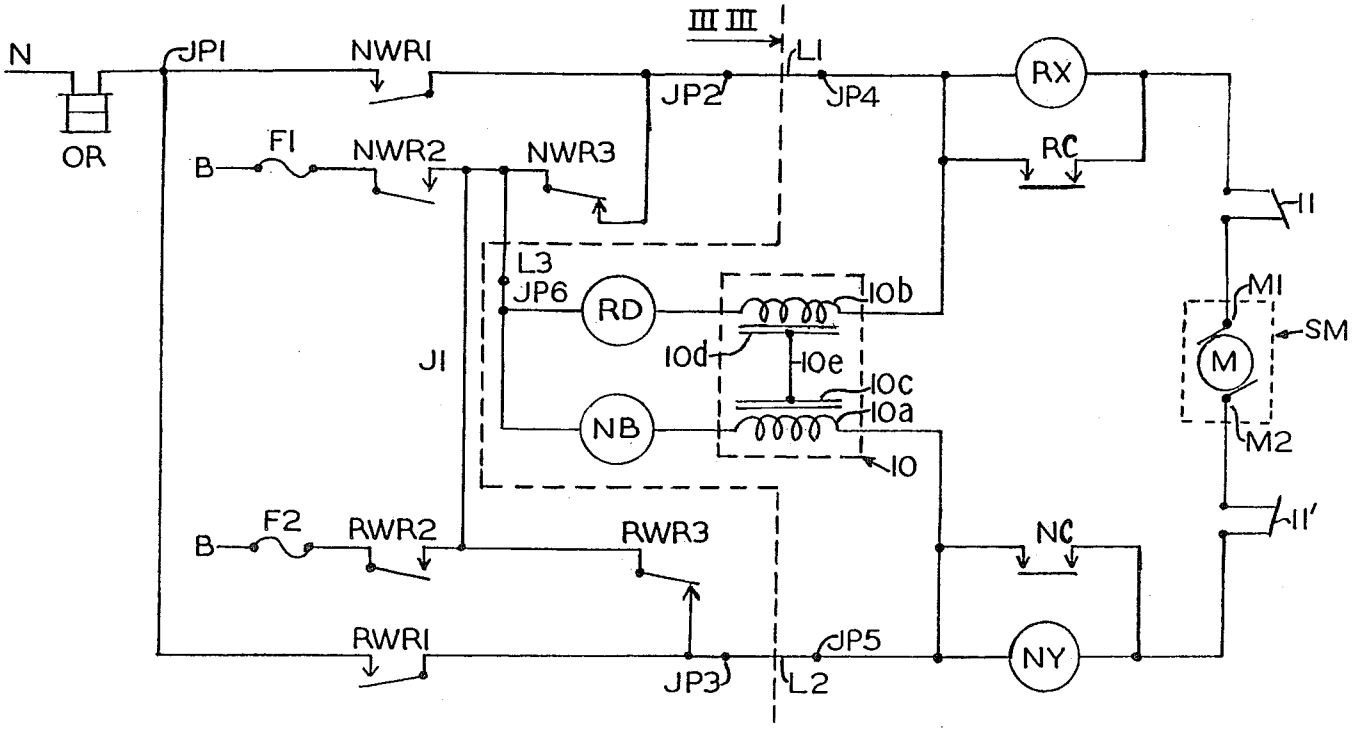
FIG. 3 is a diagrammatic view of a vital switch control circuit constructed in accordance with a second alternate embodiment of the invention.

As seen in FIG. 3, another alternate embodiment of the invention provides a vital switch control circuit for a high-voltage, three-wire arrangement. It will be observed at this time that the three-wire arrangement (shown in FIG. 3) does not provide the cost-savings with respect to wiring costs as do the previously-discussed two-wire arrangements. However, where previously existing wiring is in place from the prior system, it may be advantageous to reuse the existing connections. Additionally, it should be pointed out that, unlike the two-wire arrangements which exhibit repeated polar-changing of energy over the two-line wires L1 and L2, the three-wire arrangement of FIG. 3 will have a third line wire which does not polar-change, therefore affecting the detection of a signal cross-over failure. As was true for the first alternate embodiment, the embodiment as shown in FIG. 3 is substantially similar to that shown in FIG. 1, and therefore utilizes many of the same elements and reference designations.

Additionally, certain operations and logic are the same and will not be repeated here; for instance, the establishment of the negative and positive energy paths to the first and second line wires L1 and L2 by way of the switch-normal and switch-reverse contacts NWR1, NWR2, NWR3 and RWR1, RWR2, RWR3.

The vital switch control circuit further includes an additional arrangement for biasing the reversing contactor 10. A third line wire L3 is taken from a point between the second and third switch-normal contacts NWR2 and NWR3 beyond where the first shunt jumper J1 connects. In this manner, positive energy is fed to the reversing contactor 10, following pick-up of either the second switch-normal contact NWR2 or the second switch-reverse contact RWR2, and does not have to flow over the respective third switch-normal contacts NWR3 and switch-reverse contacts RWR3. Additionally, for biasing the reversing contactor 10, alternate reverse and normal motor contacts RD and NB are provided. The alternate reverse and normal motor contacts RD and NB differ from the respective first reverse and first normal motor contacts RX and NY and the information they convey when actuated or closed, and the time at which the alternate motor contacts are actuated with respect to the normal and reverse motor contacts NY and RX. For the purposes of this embodiment of the vital switch control circuit, it is only pertinent that the alternate motor contacts RD and NB do not remain closed as long as the respective normal and reverse motor contacts RX and NY are, in fact, closed only at the initiation of a switch-position request sufficiently long, to allow energization of the opposite position coil of the reversing contactor 10, the normal coil **10*d***, for instance, when the alternate reverse motor contact RD is closed.

In operation, if a switch-normal position is requested from a fully locked and indicating switch-reverse position, it is first observed that the first reverse motor contact RX and the alternate reverse motor contact RD will be closed, while the first normal motor contact NY and the alternate normal motor contact NB will be opened. Upon the request for normal switch position, the first, second and third switch-normal contacts NWR1, NWR2 and NWR3 will all be picked up. Picking up the first switch normal contact NWR1 allows negative energy to flow over the first line wire L1 to the closed first reverse motor contact RX, through the handthrow cutout contact 11, to the first motor lead M1 of the permanent magnet motor M. By way of the second normal-switch contact NWR2, the first shunt jumper J1 and the closed third switch-reverse contact RWR3, positive energy flows over the second line wire L2 to the fifth junction point JP5. This positive energy is simultaneously conveyed over a third line wire L3 to a sixth junction point JP6, where such positive energy is connected through the alternate reverse motor contact RD to one side of the normal coil **10*b*. The other side of the normal coil 10*b* receives negative energy over the fourth junction point JP4 such that the normal armature 10*d* is actuated, thereby closing the normal contact NC and allowing the positive energy, present at the fifth junction point JP5, to flow through a closed alternate manual release contact 11'** to the second motor lead M, thereby completing the circuit to the permanent magnet motor M.

Although the hereinabove forms of the embodiment constitute preferred forms, it can be appreciated that modifications can be made thereto without departing from the scope of the claimed invention as detailed in the appended claims.

We claim:

1. A vital switch control circuit for controlling the movement of a railroad switch machine to one of mutually exclusive normal- and reverse-switch positions, said vital switch control circuit comprising:

(a) a first positive-current path having disposed therein at least one normal contact which, when actuated during a request to such normal-switch position, closes said first positive-current path;

(b) a first negative-current path having disposed therein another at least one normal contact which, when actuated during such normal-switch position request, closes said first negative-current path;

(c) a second positive-current path having disposed therein at least one reverse contact which, when actuated during a request to such reverse-switch position, closes said second positive-current path;

(d) a second negative-current path having disposed therein another at least one reverse contact which, when actuated during such reverse-switch position request, closes said second negative-current path;

(e) said first positive- and negative-current paths being closed at times mutually exclusive of when said second positive- and negative-current paths are closed;

(f) motor control means connected to said first and second positive-current paths and to said first and second negative-current paths for closing an electrical connection through at least one normal motor contact when the switch machine is in such normal position, and for closing another electrical connection through at least one reverse motor contact when the switch machine is in such reverse position;

(g) a permanent magnet motor connected to at least one of said at least one normal motor contact and to at least one of said at least one reverse motor contact such that, one of said first and second negative-current paths is connected to a first motor lead to said permanent magnet motor; and (h) interlocking contactor means disposed between said motor control means and said permanent magnet motor for sensing the polarity of the energy applied to said first and second positive current paths and connecting respectively one of said first and second positive current paths to a second motor lead of said permanent magnet motor.

2. A vital switch control circuit, as set forth in claim 1, wherein said permanent magnet motor is operable in either of the directions as a function of the polarity of energy applied to said first and second motor leads.

3. A vital switch control circuit, as set forth in claim 1, wherein said at least one normal contact includes one normally-open contact, and said another at least one normal contact disposed in said first negative-current path includes one normally-open contact, both of said normally-open contacts which are simultaneously closed upon initiation of such normal-switch position request.

4. A vital switch control circuit, as set forth in claim 3, wherein said at least one reverse contact includes one normally-open contact, and said another at least one reverse contact disposed in said second negative-current path includes one normally-open contact, both of which are simultaneously closed upon initiation of such reverse-switch position request.

5. A vital switch control circuit, as set forth in claim 4, further comprising a third normal contact disposed adjacent said another at least one normal contact, said third normal contact being a normally-closed contact which opens upon initiation of such normal-switch position request.

6. A vital switch control circuit, as set forth in claim 5, further comprising a third reverse contact disposed adjacent said another at least one reverse contact, said third reverse contact being a normally-closed contact which opens upon such initiation of such reverse-switch position request, and a shunt jumper connecting said first positive-current path to said second positive-current path at a point between said another at least one normal contact and said third normal contact on said first positive-current path and a second point between said another at least one reverse contact and said third reverse contact on said second positive-current path.

7. A vital switch control circuit, as set forth in claim 2, wherein positive energy from one of said first and second positive-current paths and a negative connection from one of said first and second negative-current paths are connected to said motor control means over a first and a second line wire.

8. A vital switch control circuit, as set forth in claim 7, wherein such positive energy and such negative connection are connected to said first and second line wires in a polarity-chargeable arrangement wherein such positive energy can alternately flow over either of said first and second line wires.

9. A vital switch control circuit, as set forth in claim 2, wherein said at least one normal motor contact is closed from a time when the switch machine is in such normal position until just prior to the switch machine reaching such reverse position, and said at least one reverse motor contact is closed from a time when the switch machine is in such reverse position until just prior to the switch machine reaching such normal position.

10. A vital switch control circuit, as set forth in claim 9, wherein said interlocking contactor means includes a normal coil and normal contact configuration and a reverse coil and reverse contact configuration, said normal coil being energized to shunt over said at least one reverse motor contact following initiation of such normal-switch position request such that said normal contact is closed thereby, and said reverse coil is energized to shunt over said at least one normal motor contact following initiation of such reverse switch position request such that, said reverse contact is closed thereby.

11. A vital switch control circuit, as set forth in claim 10, wherein said interlocking contactor means further includes a normal armature associated with said normal coil and a reverse armature associated with said reverse coil and a mechanical interlock element which mechanically joins said normal armature to said reverse armature such that, opposing independent movement between said normal armature and said reverse armature is prevented.

12. A vital switch control circuit, as set forth in claim 11, wherein said at least one normal motor contact of said motor control means includes a first normal motor contact which when closed, connects said second negative-current path to said second motor lead of said permanent magnet motor and a second normal motor contact which when closed, connects said second positive-current path to said reverse coil.

13. A vital switch control circuit, as set forth in claim 12, wherein said at least one reverse motor contact of said motor control means includes a first reverse motor contact which when closed, connects said first negative-current path to said first motor lead of said permanent magnet motor and a second reverse motor contact which when closed, connects said first positive-current path to said normal coil.

14. A vital switch control circuit, as set forth in claim 9, wherein said interlocking contactor means includes a normal coil and normal contact configuration and a reverse coil and reverse contact configuration; said normal coil being energized to shunt over said first positive-current path when closed, said first negative-current path when closed, and a first steering diode arranged such that positive energy, present when said second positive-current path is closed, is prevented from connecting to said normal coil; and said reverse coil being energized to shunt over said second positive-current path when closed, said second negative-current path when closed, and a second steering diode arranged such that negative energy, present when said first negative-current path is closed, is prevented from connecting to said reverse coil.

15. A vital switch control circuit, as set forth in claim 9, wherein said at least one normal motor contact includes a first and a second normal motor contact connected in series such that, said second negative-current path is connected to said second motor lead of said permanent magnet motor thereover, and wherein said at least one reverse motor contact includes a first and a second reverse motor contact connected in series such that, said first negative-current path is connected to said first motor lead of said permanent magnet motor.

16. A vital switch control circuit, as set forth in claim 2, further comprising a handthrow cutout contact connected to one of said first and second motor leads of said permanent magnet motor such that, upon initiation of a manual operation of the switch machine, energy to said permanent magnet motor is interrupted.

17. A vital switch control circuit, as set forth in claim 2, further comprising an overload relay connected to said first and said second negative-current paths, said overload relay remaining deenergized and thereby allowing negative energy to flow therethrough for a predetermined overload time, said overload relay being energized following expiration of such predetermined overload time only when such current flows thereover longer than such predetermined overload time.

18. A vital switch control circuit, as set forth in claim 2, further comprising a first fuse element disposed in said first positive-current path, and a second fuse disposed in said second positive-current path.

19. A vital switch control circuit, as set forth in claim 6, further comprising a third line wire connected to said shunt jumper such that, said first and second positive-current paths can be connected to said interlocking contactor means.

* * * * *

UNITED STATES PATENT AND TRADEMARK OFFICE

CERTIFICATE OF CORRECTION

PATENT NO. : 4,756,494

DATED : July 12, 1988

INVENTOR(S) : Robert A. Kondratenko & Jack Cunningham

It is certified that error appears in the above-identified patent and that said Letters Patent are hereby corrected as shown below:

Column 10, line 67, insert a hyphen before"exclusive"

same line, after "normal" delete the hyphen

Column 11, line 16, after "negative" delete the hyphen line 17, after "positive" delete the hyphen same line, after "negative" delete the hyphen line 19, after "positive" delete the hyphen same line, after "negative" delete the hyphen line 53, after "normally" delete the hyphen line 62, after "reverse" delete the hyphen

UNITED STATES PATENT AND TRADEMARK OFFICE

CERTIFICATE OF CORRECTION

PATENT NO. : 4,756,494

DATED : July 12, 1988

INVENTOR(S) : Robert A. Kondratenko et al.

It is certified that error appears in the above-identified patent and that said Letters Patent is hereby corrected as shown below:

Column 12, line 15, after "positive" delete the hyphen

Signed and Sealed this

Seventeenth Day of January, 1989

*Attest:*

DONALD J. QUIGG

*Attesting Officer*

*Commissioner of Patents and Trademarks*